US009822654B2

(12) United States Patent
Brandl et al.

(10) Patent No.: US 9,822,654 B2
(45) Date of Patent: Nov. 21, 2017

(54) ARRANGEMENT FOR COOLING A COMPONENT IN THE HOT GAS PATH OF A GAS TURBINE

(71) Applicant: ALSTOM Technology Ltd, Baden (CH)

(72) Inventors: Herbert Brandl, Waldshut-Tiengen (DE); Andrey Anatolievich Sedlov, Moscow (RU); Artem Ivanov, Moscow (RU)

(73) Assignee: ANSALDO ENERGIA IP UK LIMITED, London (GB)

( * ) Notice: Subject to any disclaimer, the term of this patent is extended or adjusted under 35 U.S.C. 154(b) by 481 days.

(21) Appl. No.: 14/505,588

(22) Filed: Oct. 3, 2014

(65) Prior Publication Data

US 2015/0110612 A1 Apr. 23, 2015

(30) Foreign Application Priority Data

Oct. 10, 2013 (EP) ..... 13188150

(51) Int. Cl.

| | |
|---|---|
| ***F01D 9/06*** | (2006.01) |
| ***F01D 25/14*** | (2006.01) |
| ***F01D 11/08*** | (2006.01) |

(52) U.S. Cl.

CPC ..... *F01D 9/065* (2013.01); *F01D 9/06* (2013.01); *F01D 11/08* (2013.01); *F01D 25/14* (2013.01);

(Continued)

(58) Field of Classification Search

CPC . F01D 9/06; F01D 9/065; F01D 11/08; F01D 25/14; F05D 2240/11; F05D 2240/15

See application file for complete search history.

(56) References Cited

U.S. PATENT DOCUMENTS 5,538,393 A * 7/1996 Thompson ..... F01D 25/12 415/115
7,740,161 B2 * 6/2010 Boman ..... F02K 9/64 228/101

(Continued)

FOREIGN PATENT DOCUMENTS

CA 2 644 099 A1 9/2007
DE 44 43 864 A1 6/1996

(Continued)

*Primary Examiner* — Ninh H Nguyen
*Assistant Examiner* — Brian P Wolcott
(74) *Attorney, Agent, or Firm* — Buchanan Ingersoll & Rooney PC

(57) ABSTRACT

A cooled wall segment in the hot gas path of a gas turbine. The wall segment includes a first surface, exposed to a medium of relatively high temperature, a second surface, exposed to a medium of relatively low temperature, and side surfaces connecting the first and second surface and defining a height of the wall segment. At least one cooling channel for a flow-through of a fluid cooling medium extends through the wall segment. Each cooling channel is provided with an inlet and an outlet for the cooling medium. The at least one cooling channel includes at least two heat transfer sections, a first heat transfer section extending essentially parallel to the first surface at a first distance from the first surface and a second heat transfer section extending essentially parallel to the first surface at a second distance, whereby the second distance is less than the first distance.

15 Claims, 4 Drawing Sheets

(52) U.S. Cl.
CPC ..... *F05D 2240/11* (2013.01); *F05D 2240/15* (2013.01)

(56) References Cited

U.S. PATENT DOCUMENTS

| | | | | |
|---|---|---|---|---|
| 8,727,704 | B2 * | 5/2014 | Lee | F01D 11/08 415/116 |
| 8,915,701 | B2 * | 12/2014 | Black | F02C 7/00 415/116 |
| 2011/0255989 | A1 * | 10/2011 | Koyabu | F01D 11/24 416/97 R |

FOREIGN PATENT DOCUMENTS

| | | | |
|---|---|---|---|
| EP | 1 249 591 | A2 | 10/2002 |
| EP | 1 517 008 | A2 | 3/2005 |
| EP | 2 369 135 | A2 | 9/2011 |
| WO | 2004/035992 | A1 | 4/2004 |
| WO | 2008/100306 | A2 | 8/2008 |
| WO | 2010/009997 | A1 | 1/2010 |

* cited by examiner

ARRANGEMENT FOR COOLING A COMPONENT IN THE HOT GAS PATH OF A GAS TURBINE

CROSS-REFERENCE TO RELATED APPLICATIONS

This application claims priority to European application 13188150.0 filed Oct. 10, 2013, the contents of which are hereby incorporated in its entirety.

TECHNICAL FIELD

The present invention relates to the field of gas turbines, in particular to a cooled stator component in the hot gas path of a gas turbine. Such components, e.g. stator heat shields, have to be properly cooled in order to avoid thermal damages of these components and to ensure a sufficient lifetime.

BACKGROUND

The cooling of a stator heat shield is a challenging task. The heat shields are exposed to the hot and aggressive gases of the hot gas path in the gas turbine. Film cooling of the hot gas exposed surface of the heat shield is not possible at least at those areas of the surface that are arranged opposite to the rotating blade tips. This is for two reasons. Firstly, the complex flow field in the gap between the heat shield and the blade tip does not allow the formation of a cooling film over the surface of this component. Secondly, in case of rubbing events the cooling hole openings are often closed by this event thus preventing the exit of sufficient cooling medium for a reliable film formation with the consequence of overheating the heat shield element. In order to mitigate this risk the clearance between the blade tip and the heat shield must be increased. Currently impingement cooling methods with cooling air ejected at the side faces of the component are a widely-used solution for cooling stator heat shields. WO 2010/009997 discloses a gas turbine with stator heat shields that are cooled by means of impingement cooling in which a cooling medium under pressure, especially cooling air, from an outer annular cavity flows via perforated impingement cooling plates into impingement cooling cavities of the heat shield segment and cools the hot gas path limiting wall of the heat shield. Through ejection holes at the side faces of the heat shield the used cooling medium is ejected into the hot gas path.

According to the patent application CA 2644099 an impingement cooling structure comprises a plurality of heat shield elements connected to each other in the circumferential direction so as to form a ring-shaped shroud surrounding the hot gas path and a shroud cover installed on the radially outer surface to form a hollow cavity therebetween. Said cover has impingement holes that communicate with the cavity and perform impingement cooling of the radially inner wall of the heat shield by jetting cooling air onto its surface inside the cavity. Holed fins divide the cavity into sub-cavities. The cooling air flows through cooling holes in the fins through the fins from a first sub-cavity into a second sub-cavity. Increasing hot gas temperatures require to go down with the wall thickness of the hot gas exposed components to bring down the metal temperatures to acceptable levels. Furthermore, efficiency requirements of modern gas turbines require small clearances between the tips of the rotating blades and the heat shield. However this requirement compromises the design of these elements and their manufacturing that becomes more and more sophisticated and consequently more expensive, and the requirements of rub resistance of the hot gas exposed surfaces, because thin walls increase the risk of damages in case of a rub event.

Patent application WO 2004/035992 discloses a cooled component of the hot gas path of a gas turbine, e.g. a wall segment. The wall segment comprises a plurality of parallel cooling channels for a cooling medium. The inner surfaces of the cooling channels are equipped with projecting elements of specific shapes and dimensions to generate a turbulent flow next to the wall with the effect of an increased heat transfer.

Document DE 4443864 teaches a cooled wall part of a gas turbine having a plurality of separate convectively cooled longitudinal cooling ducts running near the inner wall and parallel thereto, adjacent longitudinal cooling ducts being connected to one another in each case via intermediate ribs. There is provided at the downstream end of the longitudinal cooling ducts a deflecting device which is connected to at least one backflow cooling duct which is arranged near the outer wall in the wall part and from which a plurality of small tubes extend to the inner wall of the cooled wall part and are arranged in the intermediate ribs branch off. By means of this wall part, the cooling medium can be put to multiple use for cooling (convective, effusion, film cooling).

DE 69601029 discloses a heat shield segment for a gas turbine, said segment including a first surface, a back side disposed opposite of the first surface, a pair of axial edges defining a leading edge and a trailing edge, first retaining means adjacent the leading edge and extending from the back side, second retaining means adjacent the trailing edge and extending from the back side, and a serpentine channel including an outer passage extending along one of the edges and outward of the retaining means extending adjacent that edge, an inner passage being inward of the outer passage and a bend passage which extends between the outer passage and the inner passage to place the inner passage in fluid communication with the outer passage, a purge hole which extends from the bend passage to the exterior of the shroud segment to discharge cooling fluid from the bend passage, and a duct extending to the inner passage from a location inward of the adjacent retaining means, the duct permitting fluid communication between the back side of the shroud segment and the serpentine channel such that a portion of the cooling fluid injected onto the back side flows through the serpentine channel, wherein cooling fluid drawn toward the purge hole under operative conditions blocks separation of the cooling fluid in the bend passage.

EP 1517008 relates to cooling arrangement for a coated wall in the hot gas path of a gas turbine based on a network of cooling channels. A gas turbine wall includes a metal substrate having front and back surfaces. A thermal barrier coating is bonded atop the front surface. A network of flow channels is laminated between the substrate and the coating for carrying an air coolant therebetween for cooling the thermal barrier coating.

To ensure sufficient emergency lifetime of the heat shield either the hot gas exposed wall must be designed with a sufficient thickness or the clearance between the blade tips and the stator heat shield must be increased in a way that rubbing contacts during transient operation conditions are excluded. However, this compromises the cooling efficiency in a negative manner.

SUMMARY

It is an object of the invention to improve the cooling efficiency of a wall segment in the hot gas path of a gas turbine, particularly of a stator heat shield. It is another object of the invention to provide a cooling arrangement for a wall segment in the hot gas path of a gas turbine, particularly of a stator heat shield that increases its emergency lifetime in case of a damage of its surface due to a rubbing event or a crack.

This object is achieved by a wall segment, e.g. a stator heat shield, according to the independent claim.

The wall segment for the hot gas path of a gas turbine according to the invention, particularly a stator heat shield, comprises at least a first surface, exposed to a medium of relatively high temperature, a second surface, exposed to a medium of relatively low temperature and side surfaces connecting said first and said second surface and defining a height of the wall segment, at least one cooling channel for a flow-through of a cooling medium extends through the wall segment, whereby the at least one cooling channel comprises (in the direction of flow of the cooling medium) an inlet section, a first heat transfer section extending essentially parallel to the said first surface of the wall segment in a first distance to the first surface, a transition section with a direction vector towards the first surface, a second heat transfer section extending essentially parallel to the first surface in a second distance to the first surface, and an outlet for the cooling medium, whereby said second distance is lower than said first distance. According to a first embodiment the inlet is arranged on the second surface exposed to the medium of relatively low temperature.

According to another embodiment the first heat transfer section of the cooling channel, running in a first distance to the first, i.e. hot surface and the second heat transfer section, running in a second distance to the first surface run parallel to each other.

Preferably the two parallel heat transfer sections are arranged with an opposite flow direction of the cooling medium.

According to a preferred embodiment of the invention the wall segment comprises a plurality of cooling channels (i.e. at least two), whereby in each case two cooling channels are arranged laterally reversed to each other.

The cooling channels have preferably a rectangular cross-section or a trapezoidal cross-section, whereby the trapeze basis is directed to the surface exposed to the medium with the relatively high temperature.

According to an alternative embodiment the cross-sectional shape of at least one cooling channel is changing over the length.

It is an essential feature of the wall segment according to the present invention that the cooling channels comprise two (or more) different heat transfer sections, whereby these different heat transfer sections are positioned in different planes within the wall segment, i.e. with different distances to the surface, exposed to the hot gas path of the gas turbine. The second cooling section runs closer to the hot surface than the first one. This section is configured to optimally cool the heat shield. The first section is further away and contributes less to the cooling of the wall segment.

As a consequence of a rub event or abnormal wear due to continuing overstraining the surface of the wall segment, especially a stator heat shield, might be destroyed and the cooling channel damaged, e.g. leaky. After such an event the first intact section of the cooling channel, arranged further away from the damaged area will take over the cooling function to a certain degree. By this measure the emergency lifetime of the heat shield may be significantly extended.

BRIEF DESCRIPTION OF THE DRAWINGS

The present invention is now explained more closely by means of different embodiments and with reference to the attached drawings.

DETAILED DESCRIPTION

Figure 1:
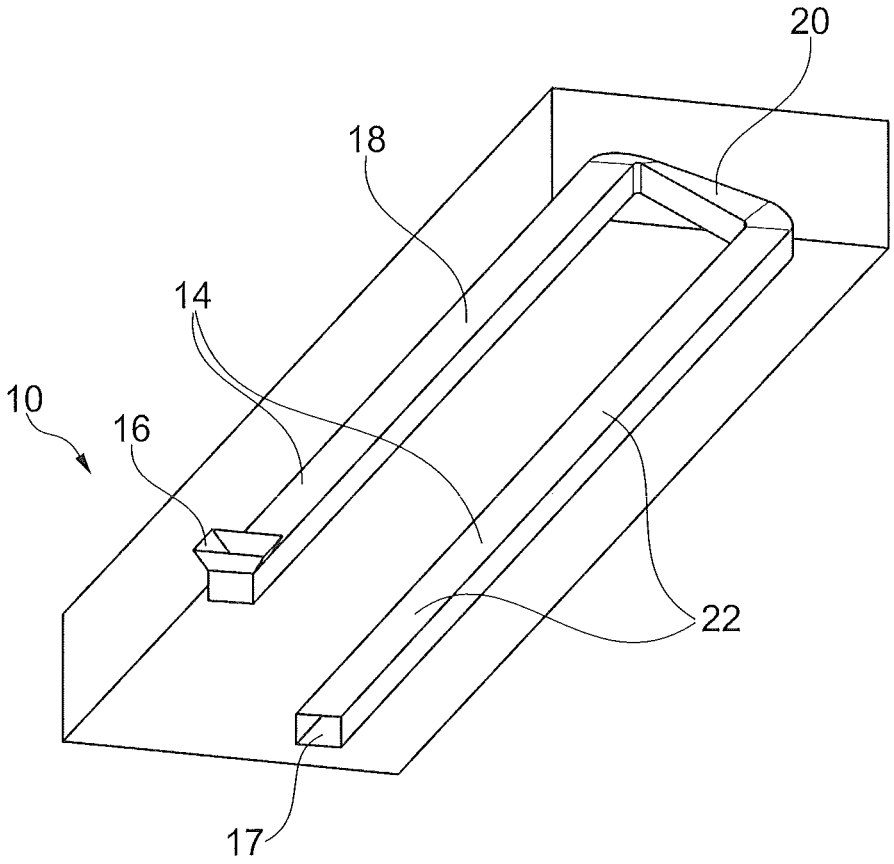
FIG. 1 schematically shows in a perspective view the basic features of a wall segment with an integrated cooling channel according to the invention.

FIG. 1 schematically shows a stator heat shield 10 of a gas turbine, with a first inner surface 11 exposed to the hot gases in the hot gas path of the gas turbine, a second outer surface 12 (see FIGS. 3-5) and four side surfaces 13. At least one cooling channel 14 for a cooling medium 15, usually cooling air, is extending inside the heat shield 10. The inlet opening 16 to pass the cooling medium 15 into the cooling channel 14 is positioned on the outer surface 12 of the heat shield 10. FIG. 1 shows in an exemplary manner a fluid inlet 16 orthogonally to the outer surface 12, but of course an inclined orientation of inlet 16 is also possible. The inlet 16 is arranged close to the side face to have a heat transfer section as long as possible. Usually, the distance to the side face may be in the range of 5% to 20% of the length of the wall segment 10. In a defined first distance 19 to the inner surface 11 the inlet section 16 ends in a first heat transfer section 18 with an orientation essentially parallel to the inner surface 11. This section 18 acts as the first heat transfer section of the cooling channel 14. At the end of this section 18 a transition section 20 follows. It is the purpose of this section 20 to transfer the cooling channel 14 onto a second plane closer to the hot gas loaded inner surface 1. Preferably in two one-quarter bends the cooling channel 14 moves into another plane closer to surface 11 and changes its flow direction into the opposite direction. Afterwards a second heat transfer section 22 follows, extending longitudinally through the heat shield 10 and in a constant distance 23 to the hot gas loaded inner surface 11. This section 22 is generally parallel to the longitudinally extending first heat transfer section 18, but extending in a plane closer to the surface 11. This part of the cooling channel 14 is the main contributor to the cooling of the hot gas loaded surface 11. At a side surface 13 the used cooling medium 15 exits the heat shield segment 10 through an outlet 17.

Figure 3:
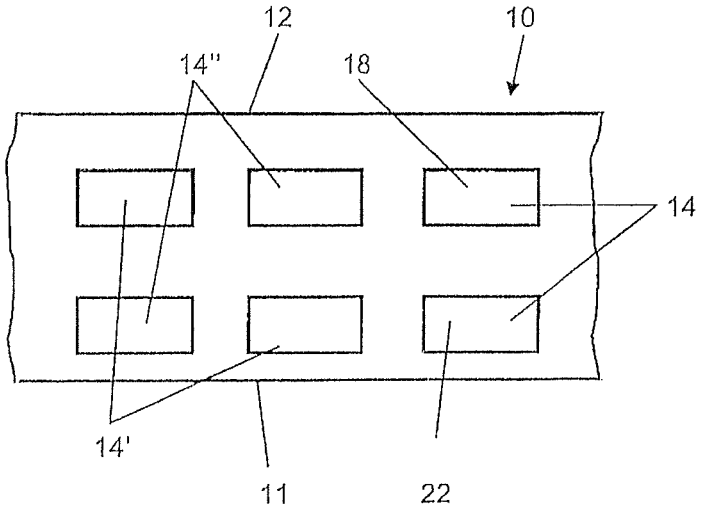
FIG. 3 shows in a cross-sectional view an embodiment of the invention.

The parallel heat transfer sections 18 and 22 of the cooling channel 14 may be arranged in a vertical line or staggered, as described later in more detail shown in FIGS. 3 and 4.

Figure 2:
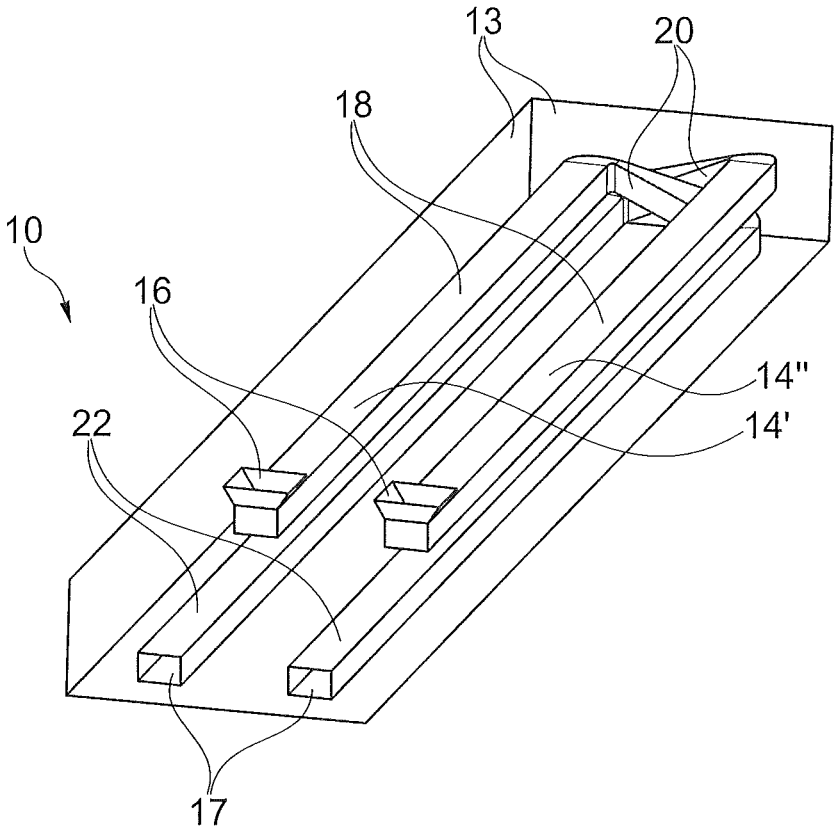
FIG. 2 shows in a similar view a wall segment with two cooling channels in laterally reversed arrangement.

Usually a stator heat shield is equipped with two or more cooling channels 14. According to a preferred embodiment in each case two cooling channels 14', 14" are laterally reversed arranged, as sketched in FIG. 2. Both cooling channels 14', 14" comprise an inlet 16 for the cooling medium 15, a first heat transfer section 18 with a first distance 19 to the hot gas loaded surface 11, a transition section 20 with a direction vector towards the surface 11, a second heat transfer section 22, essentially parallel to surface 11 and adjacent outlets 17 for the cooling medium 15 at the side surface 13. The transition sections 20 of the both channels 14', 14" have a component in the vertical direction towards the hot gas loaded surface 11 and have a component in the horizontal direction. The horizontal components are directed towards each other. As a consequence, the second heat transfer section 22 of cooling channel 14' is positioned in a vertical line with the first heat transfer section 18 of cooling channel 14", and the second heat transfer section 22 of cooling channel 14" is positioned in a vertical line with the first heat transfer section 18 of cooling channel 14' (q.v. FIG. 3).

Figure 4:
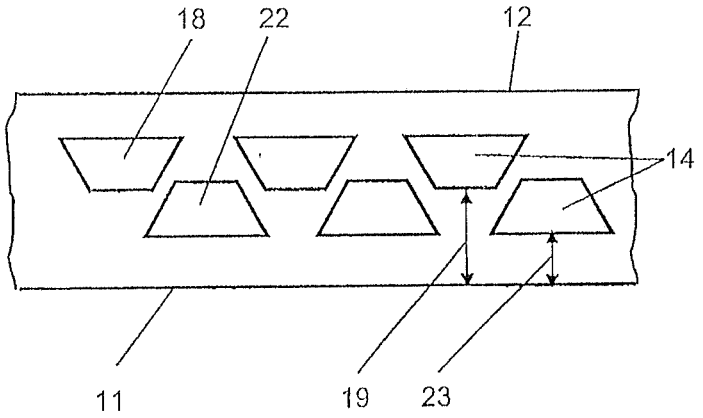
FIG. 4 shows in a cross-sectional view an embodiment of the invention.
Figure 5A:
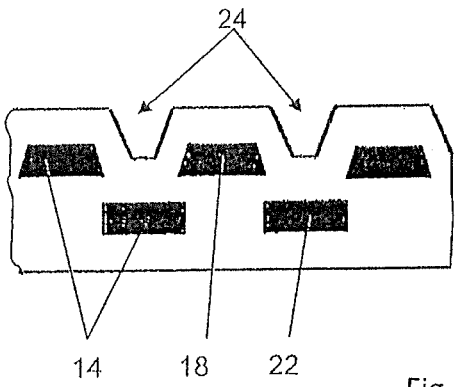
FIG. 5A shows in a cross-sectional view an embodiment of the invention.
Figure 5B:
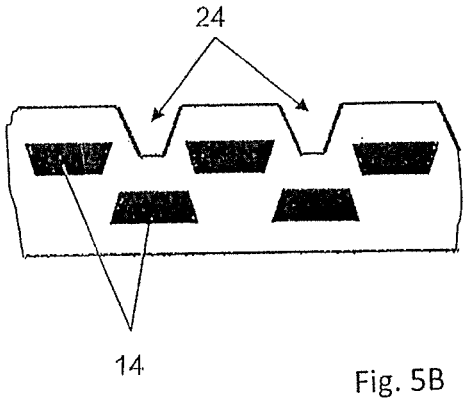
FIG. 5B shows in a cross-sectional view an embodiment of the invention.

The sketches of FIGS. 4, 5A and 5B show in a cross-sectional view alternative embodiments, whereby in each case the first heat transfer section 18 and the second heat transfer section 22 of the cooling channels 14 are staggered. Preferably the cooling channels 14 are equipped with a rectangular or trapezoidal flow cross-section.

Figure 6:
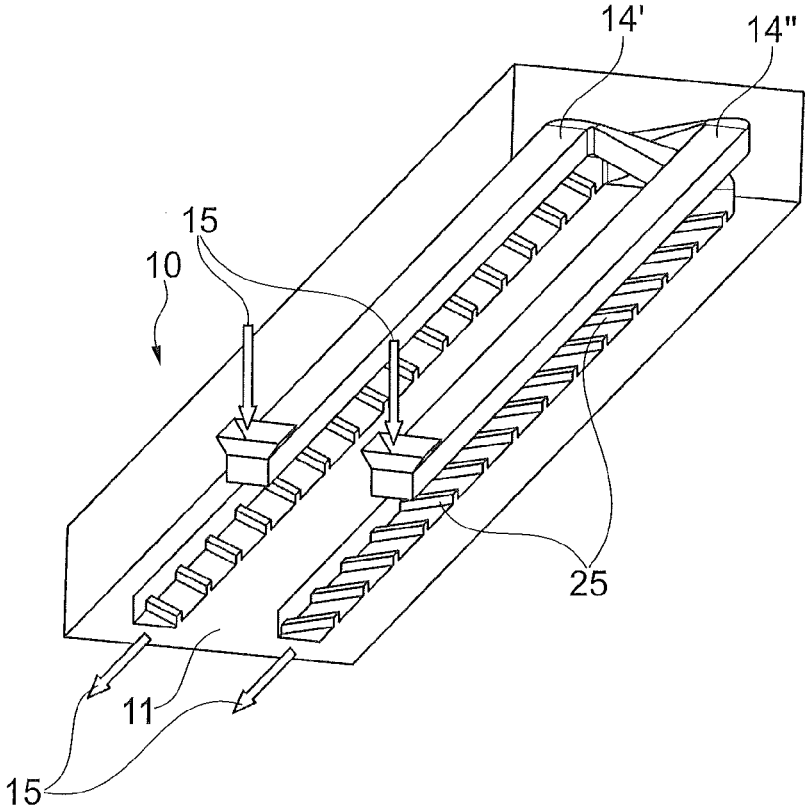
FIG. 6 shows in an embodiment cooling channels equipped with heat transfer enhancing means.

According to an alternative embodiment the cross-sectional shape of the cooling channels 14 may change over the length, e.g. from a trapezoidal cross-section to a rectangular cross-section (FIG. 5A). According to an additional embodiment the second surface 12 of the stator heat shield 10 (this surface 12 is usually exposed to the cooling medium 15) is configured with a structure 24 following the structure of the cooling channels 14 inside. This measure improves the ratio of cold to hot metal volume which in turn is beneficial for the cyclic lifetime of the component 10. In addition, this design reduces the mass of the wall segment 10 and thereby, when produced by an additive manufacturing method, such as selective laser melting (SLM), this design reduces the manufacturing of these parts in price. In a preferred embodiment, as shown in FIG. 6, the cooling channels 14', 14" are equipped with heat transfer enhancing means 25, preferably ribs. Especially these heat transfer enhancing means 25 are arranged in the second heat transfer section 22 close to the hot gas loaded surface 11.

Figure 7:
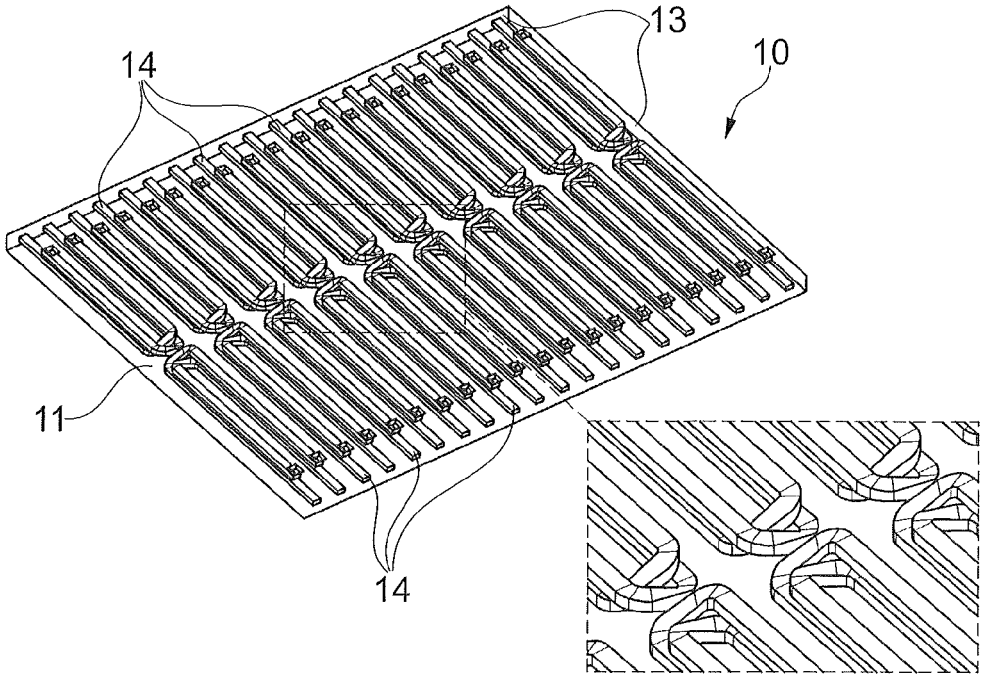
FIG. 7 shows a stator heat shield equipped with a plurality of laterally reversed arranged cooling channels.

FIG. 7 shows an embodiment of a stator heat shield 10 with a plurality of inner cooling channels 14. The cooling channels 14, 14', 14" are in each case arranged in pairs, as shown in detail in FIG. 2.

The invention claimed is:

1. A wall segment for a hot gas path of a gas turbine, comprising a first surface, exposed to a medium of a first temperature, a second surface, exposed to a medium of a second temperature that is lower than the first temperature, and side surfaces connecting said first and said second surface and defining a height of the wall segment, at least one cooling channel for a flow-through of a fluid cooling medium extending through the wall segment, each cooling channel being provided with an inlet for the fluid cooling medium and an outlet for the fluid cooling medium, wherein the at least one cooling channel comprises, a first heat transfer section extending essentially parallel to the first surface at a first distance from the first surface, a second heat transfer section extending essentially parallel to the first surface at a second distance from the first surface, whereby the second distance is less than the first distance, and a transition section in which a distance between a lower surface of the transition section and the first surface varies.

2. The wall segment according to claim 1, wherein the at least one cooling channel comprises, in succession in the direction of flow of the fluid cooling medium, an inlet section for the fluid cooling medium, the first heat transfer section extending essentially parallel to the first surface of the wall segment in the first distance, the transition section with a direction vector towards the first surface, the second heat transfer section extending essentially parallel to the first surface in the second distance and an outlet for the fluid cooling medium.

3. The wall segment according to claim 1, wherein the medium of the second temperature is the fluid cooling medium, preferably cooling air.

4. The wall segment according to claim 1, wherein the inlet is arranged on the second surface, exposed to the medium of the second temperature.

5. The wall segment according to claim 1, wherein the first section of the at least one cooling channel, running in a first distance essentially parallel to the surface, and the second section, running in a second distance essentially parallel to the surface, run parallel to each other.

6. The wall segment according to claim 5, wherein said first section and the second section run parallel to each other with an opposite flow direction of the fluid cooling medium.

7. The wall segment according to claim 2, wherein the transition section comprises two one-quarter bends.

8. The wall segment according to claim 2, wherein the transition section has a component in the vertical direction towards the first surface and has a component in the horizontal direction.

9. The wall segment according to claim 1, wherein the wall segment comprises two or more of cooling channels, whereby at least two cooling channels are arranged laterally reversed to each other.

10. The wall segment according to claim 1, wherein the second surface of the wall segment, exposed to the medium of the second temperature, is configured to follow a structure of the cooling channels inside.

11. The wall segment according to claim 1, wherein the at least one cooling channel has a rectangular cross-section.

12. The wall segment according to claim 1, wherein the at least one cooling channel has a trapezoidal cross-section, whereby the base of the trapezoid is directed to the first surface, exposed to the medium of the first temperature.

13. The wall segment according to claim 1, wherein the cross-sectional shape of at least one cooling channel is changing over the length.

14. The wall segment according to claim 1, wherein the at least one cooling channel is partly or completely equipped with heat transfer enhancing means.

15. The wall segment according to claim 14, wherein the heat transfer enhancing means are ribs.

* * * * *